US005940879A

United States Patent [19]

Whitehouse

[11] Patent Number: 5,940,879

[45] Date of Patent: Aug. 24, 1999

[54] DIVING DRYSUIT HAVING EASY ENTRY

[76] Inventor: Andrew Whitehouse, 1644 Newbridge Rd., Pocomoke, Md. 21851

[21] Appl. No.: 09/139,649

[22] Filed: Aug. 25, 1998

[51] Int. Cl.[6] ..... B63C 11/04

[52] U.S. Cl. ..... 2/2.17; 2/2.15; 2/69

[58] Field of Search ..... 2/2.15, 2.16, 2.17, 2/87, 270, 275, 311, 338, 69, 71, 79, 227, 114, 82, 83

[56] References Cited

U.S. PATENT DOCUMENTS

| | | | |
|---|---|---|---|
| 788,198 | 4/1905 | Ferger | 2/79 |
| 1,182,756 | 5/1916 | Czerkas . | |
| 1,241,598 | 10/1917 | Youngren . | |
| 1,706,097 | 3/1929 | Aud | 2/2.1 R |
| 2,582,811 | 1/1952 | Williams . | |
| 2,967,305 | 1/1961 | White et al. . | |
| 3,493,972 | 2/1970 | Oldham . | |
| 3,657,515 | 4/1972 | Smith . | |
| 3,731,319 | 5/1973 | O'Neill | 2/2.1 R |
| 4,293,957 | 10/1981 | Melarvie | 2/2.1 R |
| 4,464,795 | 8/1984 | Long et al. | 2/2.1 R |
| 4,483,019 | 11/1984 | Spangrud et al. . | |
| 4,535,477 | 8/1985 | Musto et al. . | |
| 4,547,904 | 10/1985 | Long et al. | 2/2.1 R |
| 4,829,603 | 5/1989 | Schnoor et al. | 2/69 |
| 4,862,517 | 9/1989 | Meistrell . | |
| 4,907,295 | 3/1990 | Yasuda . | |
| 5,007,112 | 4/1991 | Lewis et al. | 2/79 |
| 5,153,938 | 10/1992 | Epperson | 2/2.1 A |
| 5,159,716 | 11/1992 | Takata . | |
| 5,191,658 | 3/1993 | Meistrell . | |
| 5,331,685 | 7/1994 | Belgard . | |
| 5,621,917 | 4/1997 | Howsden | 2/111 |
| 5,642,525 | 7/1997 | Ketola | 2/16 |
| 5,802,609 | 9/1998 | Garofalo | 2/2.17 |
| 5,806,090 | 9/1998 | Johnson | 2/2.15 |
| 5,826,274 | 10/1998 | Thompson | 2/69 |
| 5,829,059 | 11/1998 | Covington | 2/79 |

FOREIGN PATENT DOCUMENTS

| | | |
|---|---|---|
| 2403932 | 5/1979 | France . |
| 406885 | 8/1966 | Switzerland . |

*Primary Examiner*—John J. Calvert
*Assistant Examiner*—Tejash D Patel
*Attorney, Agent, or Firm*—Jacobson, Price, Holman & Stern, PLLC

[57] ABSTRACT

An underwater drysuit has a zipper along the front of the drysuit. The zipper extends from one shoulder to the other and to the back side of the drysuit. The zipper has a middle section at chest level. The middle section is curved downward to form an upwardly facing extended U-shape. The ends of the zipper form reverse bends beneath the front of the shoulders. The reverse bends continue on a downward turn to the sides of each arm. The ends of the zipper terminate about midway between the shoulder and the elbow on the side of the arms.

20 Claims, 3 Drawing Sheets

DIVING DRYSUIT HAVING EASY ENTRY

BACKGROUND OF THE INVENTION

1. Field of the Invention

The present invention relates to a suit for underwater diving that allows a diver to easily enter and exit the suit. More particularly, the present invention relates to a diving suit having a zipper extending the entire width of the suit along the front of the chest region of the suit for easy entry and exit, and especially for a drysuit.

2. Description of the Related Art

Diving suits were developed in order to insulate underwater divers from cold water temperatures. Although there are various types of sophisticated diving suits, most recreational divers typically use either a "wetsuit" or a "drysuit."

Wetsuits form a layer of protection between the diver and the external water by trapping water between the diver and the suit. Once the water is trapped in the suit, the trapped water is heated by the diver's body and forms a layer of insulation between the diver and the external water. Thus, wetsuits allow water to come into contact with the diver. Wetsuits are generally formed of a rubber, foam rubber, neoprene or similar material that is able to trap water between the diver and the external water.

Drysuits, in contrast, prevent water from reaching the diver. Although the drysuit itself provides insulation, the diver also wears undergarments to keep warm. Drysuits are typically made of a waterproof fabric and may be a trilaminate construction having inner and outer fabric material layers surrounding a thin middle layer of rubber. Drysuits are more flexible than wetsuits.

The trouble with drysuits is that seals are placed about the neck, ankles (though some drysuits include a booty that is integrated into the suit to eliminate the need for an ankle seal) and wrists in order to prevent water from entering the suit. These seals are typically fashioned of rubber or the like, and form a tight fit against the diver's skin. Likewise, the drysuit itself forms a close fit to the diver so that the suit does not interfere with any of the gear that is carried by the diver, such as air tanks, buoyancy compensator, weights and the like. Accordingly, it is rather difficult and cumbersome to enter and exit the drysuit.

Conventional diving suits have included zippers or other fastening mechanisms at various positions about the suit. These systems, however, have not alleviated the difficulty of removing and donning the diving suit. Moreover, many of these suits position the zipper at locations that are subject to high stress. Consequently, the fastener tends to wear quickly and cause discomfort to the diver. In addition, many suits position a zipper along the back of the suit or in other positions that are not readily accessible to the diver.

SUMMARY OF THE INVENTION

In view of the foregoing, a primary object of the present invention is to provide a diving suit, and especially an underwater drysuit, having easy access. It is another object of the present invention to provide a fastener that permits easy access to a diving suit and is not subject to excessive wear. It is a further object to provide a drysuit with a zipper that is easy to reach. It is yet another object of the present invention to provide a drysuit having a fastener that does not interfere with gear carried by a diver or movement of the diver and does not cause discomfort to the wearer.

In accordance with these and other objects, the present invention generally comprises a drysuit having a zipper along the front of the drysuit. The zipper extends the entire width of the suit, from one arm to the other. The zipper has a middle section at the chest that is curved downward to form an upwardly facing extended U-shape. The ends of the zipper form reverse bends that pass beneath the front of the shoulders. The reverse bends continue on a downward turn along the sides of each arm. The ends of the zipper terminate about midway between the shoulder and the elbow on the side of the upper arm.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
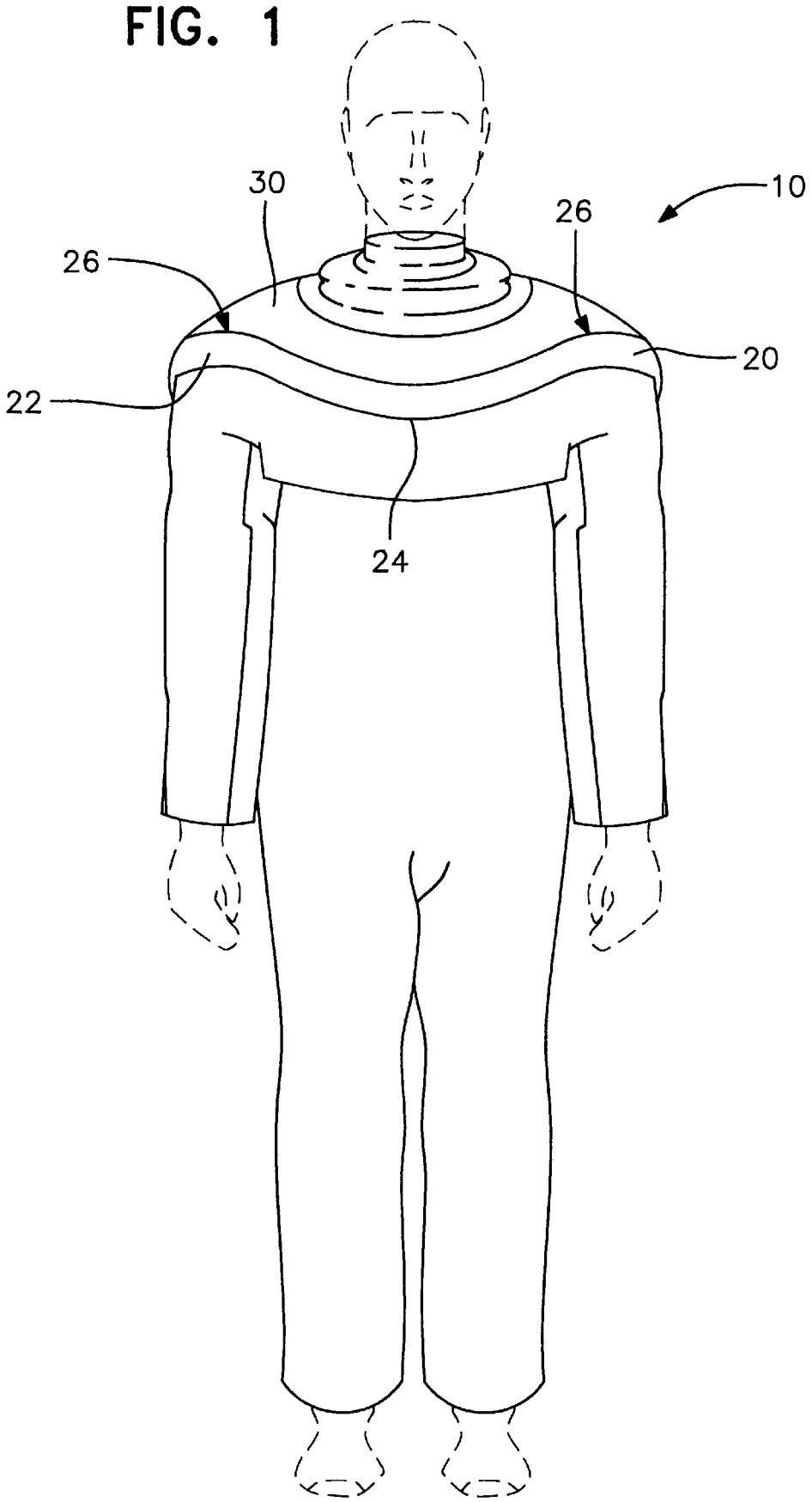
FIG. 1 is a front view of the drysuit having a fastening mechanism in accordance with the preferred embodiment of the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
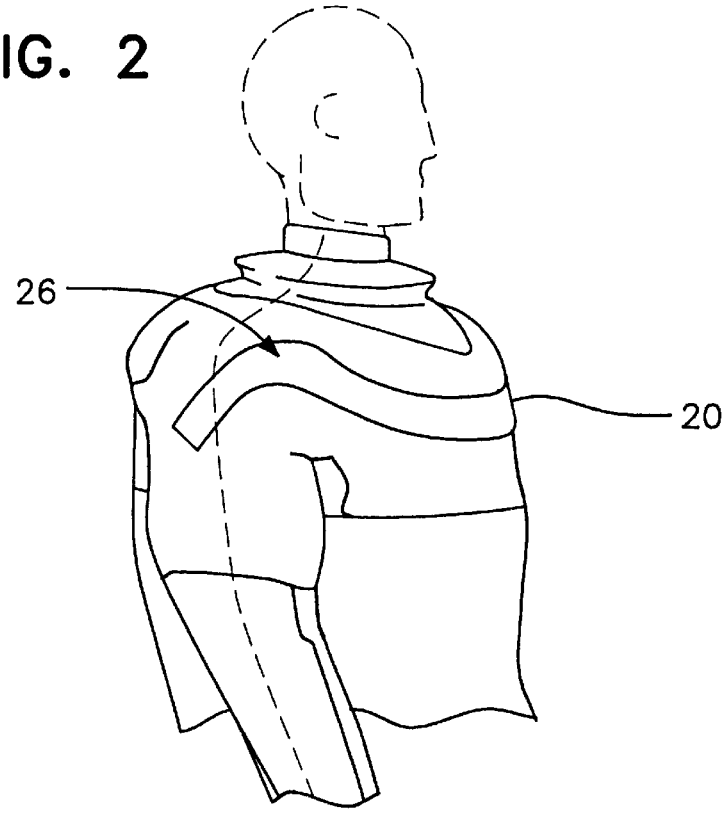
FIG. 2 is a partial side view of the drysuit showing the fastener mechanism along the side of the arm.
Figure 3:
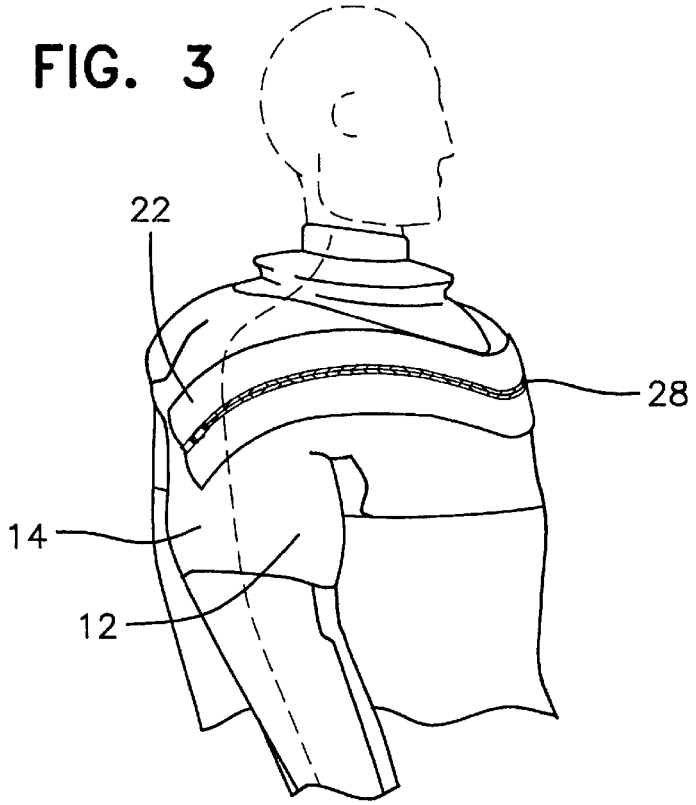
FIG. 3 is a partial side view of FIG. 2, with the flap open revealing the zipper.

Turning to the drawings, FIG. 1 shows the drysuit 10 in accordance with the preferred embodiment of the invention. The drysuit 10 is preferably a full length suit having a standard neck seal, as well as wrist and ankle seals (not shown). A fastening mechanism 20, which preferably includes a zipper 28 (better shown in FIG. 3), is positioned along the front side 12 of the suit 10 at about chest level to the diver. The zipper continues along the front and side of the upper arms of the suit 10 to reach the back side 14 of the suit 10 (FIGS. 2 and 3). FIGS. 2 and 3 are substantially similar. FIG. 2 has a sharper curvature, whereas FIGS. 1 and 3 show the drysuit with more subtle features that are less rounded.

The zipper 28 has a cover 22 that conceals the zipper 28 and guards against the zipper coming into contact with external objects. The cover 22 protects the zipper 28 from becoming damaged, as well as the external objects that may otherwise come into contact with the zipper 28. When the zipper 28 is in a closed position, the suit 10 forms a waterproof seal to prevent water from entering the suit 10.

The fastener mechanism 20 extends completely across the front of the suit 10 from one arm to the other. Along the front of the drysuit 10, the middle section 24 of fastener 20 is curved downward at the chest to generally form an upwardly facing extended U-shape. As shown in the preferred embodiment of FIGS. 2 and 3, the end sections of the zipper form reverse bends 26. The reverse bends 26 start just below the front of the shoulders and continue on a downward turn along the side of each arm. Thus, the zipper 28 passes below the front of the shoulder to form a general sinusoidal shape.

The ends of the zipper 28 terminate about midway between the shoulder and the elbow at the side arm. The ends further terminate toward the back side of the arm (to the left of the dashed lines in FIGS. 2 and 3), so that the zipper 28 extends on the back side of the suit 10. Thus, the zipper 28 preferably extends beyond the middle of the arm. The fastening mechanism 20 is preferably located at the chest level since that is typically the widest part of a wearer's body. Accordingly, the opening 32 created by the zipper 28 is wider than the widest part of the wearer.

In addition, the fastener 20 is located at chest level so that it can be easily reached by the diver. Moreover, the fastener 20 creates a flap 30 of sufficient size to be grasped by the diver to assist in the neck seal being placed over the diver's head. However, the zipper may be located at any suitable position other than at chest level.

Figure 4:
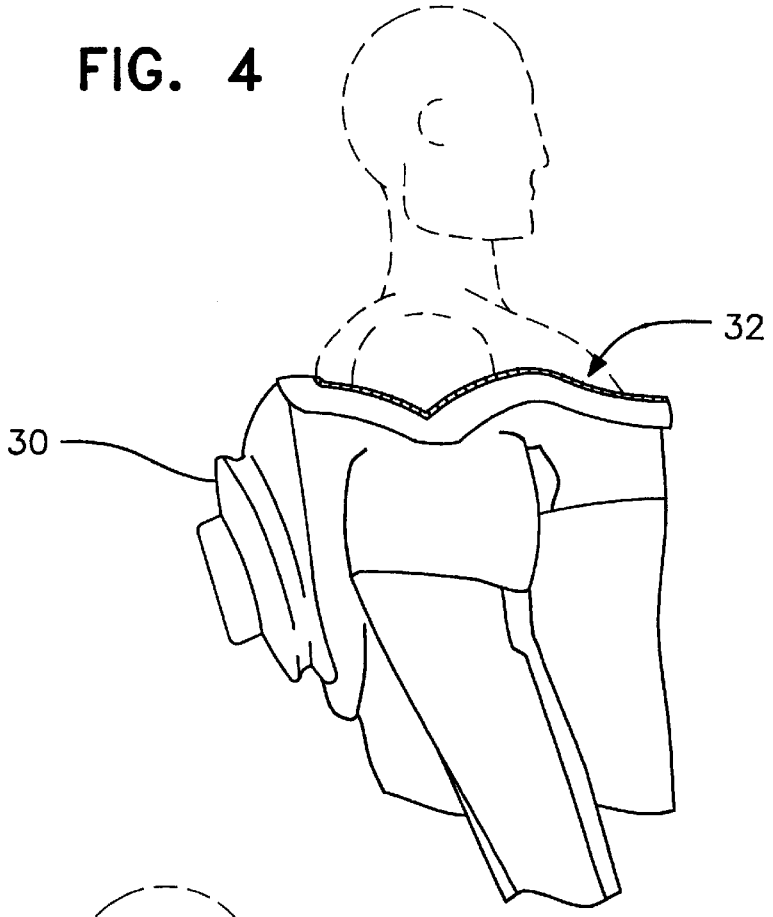
FIG. 4 is a partial side view of the drysuit with the flap open to permit entry and exit of the diver.

The zipper 28 defines a flap portion 30 in the suit 10. As best shown in FIG. 4, when the zipper 28 is opened, the flap portion 30 may be pushed back to create an opening 32 in the drysuit. The diver may then exit and enter the suit through opening 32. When the flap is pushed back, it lays out of the way of the diver so that the diver does not have to continually push the flap 30 aside.

Since the zipper 28 extends to the side of the suit 10, the positioning of the fastening mechanism 20 allows for a maximum opening 32 to be created. The extended U-shaped middle section 24 better disperses any tension on the zipper 20 and creates a greater portion of flap 30. The curved middle section 24 further makes it easier for the diver to open and close the zipper 28.

The length of the zipper 28 is preferably kept to a minimum in order to reduce the time and effort required for the diver to open and close the zipper 28. Thus, the curvature of the middle section 24 preferably has a moderate slope. This design also avoids difficulty in operating the zipper and may also reduce wear of the zipper. However, the zipper 28 may extend in any suitable configuration, including having sharp angles or the like.

The reverse bend 26 allows the length of the zipper 28 to be increased, which results in a greater opening 32 that is lower on the suit 10. The reverse bend 26 further allows the zipper 28 to extend the full width of the suit 10 and also permits the flap 30 to hang behind the diver when the suit is opened and the flap is pushed back. The reverse bend 26 does not interfere with movement by the diver.

The suit 10 can easily be taken on and off. To don the suit 10, the zipper 28 is opened to create opening 32. The diver steps into the opening 32, pulls the suit 10 all the way up, and fully inserts each arm into a sleeve of the suit 10. Since the zipper 28 extends the full width of the suit, and is at the widest part of suit 10, the opening has a greater width than the widest part of the diver. Thus, it is easy for the wearer to pull the suit 10 up and place his or her arms in the sleeves of the suit.

The flap 30 is then pulled over the diver's head, which is inserted through the neck seal. The flap 30 is pulled down so that the top part of the zipper 28 comes into alignment with the bottom part of the zipper 28. The zipper 28 is then closed and the cover 22 pressed down. The suit 10 is preferably removed in the reverse manner.

During use of the drysuit 10, the diver carries various types of equipment, such as a buoyancy compensator, tanks, and weights. Some of these devices have straps, suspenders or other like members that extend over the shoulders of the diver. Consequently, the weight of the equipment is transferred to the diver's shoulder, creating a great amount of tension on the suit. In addition, as the diver moves, the straps tend to work back and forth, creating added pull and tension on the suit.

Accordingly, the zipper 20 is positioned to avoid the top and front portions of the shoulder. Thus, the zipper 20 is not subject to undue tension or the pulling motion of any strap that might be placed over the diver's shoulders. By placing the zipper off the shoulder, the zipper (or any folds or creases associated with the zipper) does not press into the diver's skin due to weight transferred to the shoulders due to any equipment being carried by the diver.

The zipper 20 is preferably a straight zipper that is sewn or otherwise affixed to the suit 10 in the arcuate manner shown and described herein. The reverse bend 26 may straighten slightly when the arms are raised. The reverse bend 26 be sewn straight into the suit with the arms in a raised position. However, the reverse bend 26 lays curved when the arms are to the diver's side. The total length of the zipper depends on the size of the drysuit 10. Typically, however, the zipper is approximate 30 to 40 inches, and usually about 34 to 36 inches in length, though larger or smaller sizes may be used depending on the size of the suit.

Figure 5:
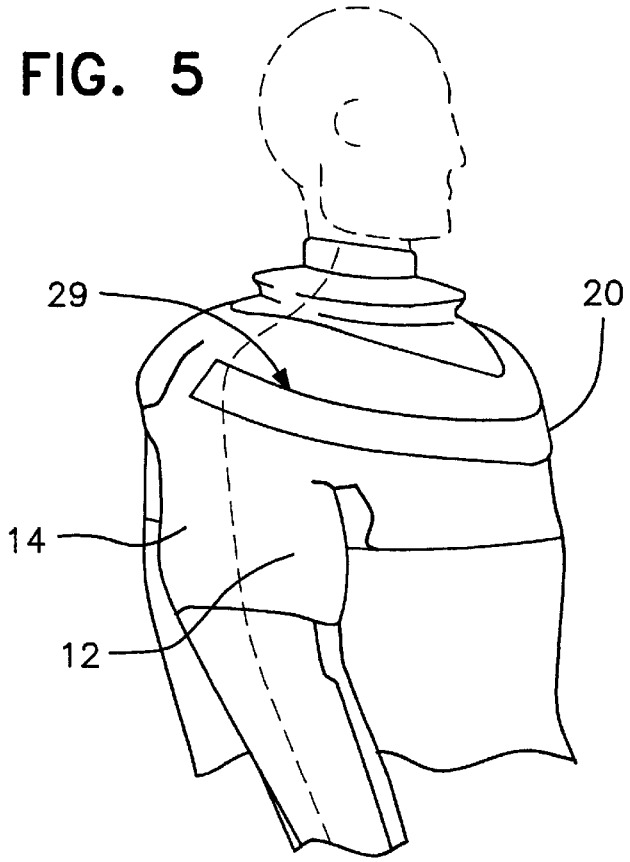
FIG. 5 is a partial side view of the drysuit in accordance with an alternative embodiment of the invention.

Yet another embodiment of the invention is shown in FIG. 5. Here, one or preferably both of the reverse bends shown in FIGS. 1–4 have been eliminated. The ends 29 of the fastening mechanism 20 continue on the extended U-shaped pattern along the side arm of the suit. Preferably, the ends 29 extend to the back side 14 of the suit and below the shoulder. However, the ends 29 may not extend to the side of the arms, but may instead terminate on the front chest of the suit. In this fashion, the fastener 20 forms a U-shape. The fastener 20 forms flap 30 having an elliptical shape to enable the diver to pull the flap over the diver's head during donning and removal of the suit.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the zipper need not extend the full width of the front of the drysuit to both arms. In addition, the position and design of the fastener may be used in either a drysuit or a wetsuit. Therefore, it is not desired to limit the invention to the specific examples disclosed or the exact construction and operation shown and described. Rather, all suitable modifications and equivalents may be resorted to, falling within the scope of the invention.

I claim:

1. A diving suit comprising a front side, a rear side, the front and rear sides each including a first shoulder, a second shoulder and an upper torso, and a fastening mechanism extending along the upper torso of said front side to said rear side without crossing over a top of either of said first shoulder or said second shoulder.

2. The diving suit of claim 1, wherein said fastening mechanism passes below said first shoulder and said second shoulder of said front side.

3. The diving suit of claim 1, the front and rear sides further including a first arm and a second arm, said fastening mechanism extending along at least one of said first and second arms of the front side to said rear side of the at least one first and second arm.

4. The diving suit of claim 1, the front and rear sides further including a first arm and a second arm, said fastening mechanism extending an entire width of said suit, from the front side of the first arm to the front side of the second arm.

5. The diving suit of claim 1, said fastening mechanism having a middle section substantially forming an upwardly facing U-shaped curve.

6. The diving suit of claim 1, the front and rear sides further including a first arm and a second arm, said fastening mechanism having an end that extends to at least one of the front side of the first and second arms, said end forming a downwardly-turned bend.

7. The diving suit of claim 1, the front and rear sides further including a first arm and a second arm, said fastening mechanism having a middle section substantially forming an upwardly facing general U-shape curve and an end that extends to at least one of the front side of the first and second arms, said end continuous with said middle section and forming a reverse bend with said middle section.

8. The diving suit of claim 1, the front and rear sides further including a first arm and a second arm, said fastening mechanism extending to at least one of the front side of the first and second arms and below the front side of the respective first and second shoulder.

9. The diving suit of claim 1, said fastening mechanism forming a watertight seal.

10. A suit for diving, the suit comprising an upper torso, a first arm, a second arm and a fastening mechanism having a middle section and at least one end, the middle section of said fastening mechanism forming an upwardly facing U-shaped curve extending along said upper torso, the at least one end continuous with the middle section and forming a downwardly-turned reverse bend with the middle section and extending to at least one of said first and second arms.

11. The suit of claim 10, the upper torso, first arm and second arm each having a respective front side and rear side, said fastening mechanism extending along the front side of the upper torso and the front side of at least one of said first and second arms to said rear side of said at least one first and second arms.

12. The suit of claim 10, said fastening mechanism extending an entire width of said suit, from the first arm to the second arm along the upper torso.

13. The suit of claim 10, said suit having a first and second shoulder, said fastening mechanism extending to at least one of said first and second arms and below a respective first and second shoulder.

14. The suit of claim 10, said fastening mechanism forming a watertight seal.

15. The suit of claim 10, said fastening mechanism comprising a zipper.

16. An underwater diving drysuit comprising a front side having a first arm, a second arm and an upper torso, and a fastening mechanism extending along the front side of the upper torso and at least one of said first and second arms, said fastening mechanism having a middle section substantially forming an upwardly facing U-shaped curve and an end forming a downwardly-turned reverse bend with respect to the U-shaped middle section.

17. The underwater diving drysuit of claim 16, the first and second arms each having a rear side, the end of said fastening mechanism extending to the rear side of at least one first and second arms of the drysuit.

18. The underwater diving drysuit of claim 16, the fastening mechanism extending an entire width of said drysuit.

19. The suit of claim 16, said suit having a first and second shoulder, said fastening mechanism extending to at least one of said first and second arms and below a respective first and second shoulder.

20. The suit of claim 16, wherein the end extends to said first arm, said fastening mechanism further comprising an opposite end extending to said second arm, the opposite end forming a downwardly-turned reverse bend with respect to the U-shaped middle section.

* * * * *